US008036564B2

(12) United States Patent
Takehara

(10) Patent No.: US 8,036,564 B2
(45) Date of Patent: Oct. 11, 2011

(54) IMAGE FORMING APPARATUS INCLUDING COOLING DEVICE

(75) Inventor: Kenichi Takehara, Sagamihara (JP)

(73) Assignee: Ricoh Company Limited, Tokyo (JP)

( * ) Notice: Subject to any disclaimer, the term of this patent is extended or adjusted under 35 U.S.C. 154(b) by 335 days.

(21) Appl. No.: 12/428,570

(22) Filed: Apr. 23, 2009

(65) Prior Publication Data

US 2009/0269099 A1 Oct. 29, 2009

(30) Foreign Application Priority Data

Apr. 28, 2008 (JP) ..... 2008-117029

(51) Int. Cl.
*G03G 21/20* (2006.01)
*G03G 15/16* (2006.01)

(52) U.S. Cl. ..... 399/94; 399/122

(58) Field of Classification Search ..... 399/91, 399/94, 111, 122, 320; 219/216; 137/340; 165/104.31, 104.33
See application file for complete search history.

(56) References Cited

U.S. PATENT DOCUMENTS

| | | | | |
|---|---|---|---|---|
| 5,566,906 | A | 10/1996 | Kamada et al. | |
| 6,501,500 | B1 * | 12/2002 | Olenio et al. | 347/263 |
| 6,510,299 | B2 * | 1/2003 | Baughman | 399/92 |
| 7,224,921 | B2 | 5/2007 | Iijima et al. | |
| 7,356,277 | B2 | 4/2008 | Iijima et al. | |
| 7,398,028 | B2 * | 7/2008 | Nakagaki | 399/69 |
| 7,400,842 | B2 | 7/2008 | Takehara et al. | |
| 2002/0085855 | A1 | 7/2002 | Baughman | |
| 2011/0052248 | A1 * | 3/2011 | Nishimura et al. | 399/94 |
| 2011/0052249 | A1 * | 3/2011 | Iijima et al. | 399/94 |

FOREIGN PATENT DOCUMENTS

| | | | |
|---|---|---|---|
| JP | 2005-17552 | | 1/2005 |
| JP | 2005-91522 | | 4/2005 |
| JP | 2005140968 | A * | 6/2005 |
| JP | 2005148659 | A * | 6/2005 |
| JP | 2005227610 | A * | 8/2005 |
| JP | 2006-3628 | | 1/2006 |
| JP | 2006091095 | A * | 4/2006 |
| JP | 2007024985 | A * | 2/2007 |
| JP | 2007129638 | A * | 5/2007 |
| JP | 2007-226078 | | 9/2007 |

OTHER PUBLICATIONS

Office Action issued Aug. 20, 2010, in Chinese Patent Application No. 200910132192.0.

* cited by examiner

*Primary Examiner* — Robert Beatty
(74) *Attorney, Agent, or Firm* — Oblon, Spivak, McClelland, Maier & Neustadt, L.L.P.

(57) ABSTRACT

An image forming apparatus comprising a main body, a cooling device, and a coupling assembly. The cooling device cools a cooling target such as a heat generator, and includes a heat-receiving section forming a heat-receiving-section channel through which a coolant flows to absorb heat from the cooling target, a cooling section to cool the coolant, and a circulation path to circulate the coolant between the heat-receiving section and the cooling section, cooling the coolant at the heat-receiving section, and transporting the coolant back to the heat-receiving section. The cooling target is detachable from the main body together with the heat-receiving section. The cooling section is provided at the main body. The coupling assembly connects the heat-receiving-section channel and the circulation path to circulate the coolant between the heat-receiving section and the cooling section whether with the cooling target installed in or detached from the main body.

12 Claims, 9 Drawing Sheets

IMAGE FORMING APPARATUS INCLUDING COOLING DEVICE

CROSS-REFERENCE TO RELATED APPLICATIONS

The present patent application claims priority pursuant to 35 U.S.C. §119 from Japanese Patent Application No. 2008-117029, filed on Apr. 28, 2008 in the Japan Patent Office, the entire contents of which are hereby incorporated herein by reference.

BACKGROUND OF THE INVENTION

1. Field of the Invention

Illustrative embodiments of the present invention relate to an image forming apparatus, such as a copier, a printer, or a facsimile, and more specifically, to an image forming apparatus including a cooling device to cool a heat generator and/or an imaging unit that is located near the heat generator.

2. Description of the Background

A conventional image forming apparatus includes a cooling device to cool a heat generator. The heat generator is usually provided in a fixing device or other such device. Sometimes the heat generator is provided at an imaging unit that is located near the heat generator.

Typically, the cooling device employs a fluid cooling method involving circulating a coolant. In the fluid cooling method, a heat-receiving section including a channel (hereinafter, a "heat-receiving-section channel") through which a coolant flows is provided near the heat generator or the imaging unit. When the coolant absorbs heat from the heat generator or its neighboring portion at the heat-receiving section, the coolant having taken the heat is transported from the heat-receiving-section channel to a cooling section, where a radiator or the like of the cooling section radiates heat from the coolant to cool the coolant. Then, the coolant is transported back to the heat-receiving-section channel. Thus, the coolant is circulated between the heat-receiving section and the cooling section to cool the heat generator or the imaging unit.

Conventional image forming apparatuses are known that include a cooling device employing a fluid cooling method to cool a detachable process cartridge installed in the apparatus. These apparatuses may be configured so that the cooling device is provided at a main body, or the cooling device is provided at the main body while the heat-receiving section of the cooling device is integrated into the process cartridge.

In a conventional image forming apparatus, the fixing device may be detachable from the main body of the apparatus to allow paper jams to be cleared and servicing to be performed. During a fixing operation carried out by the fixing device, the temperature of the fixing device may rise up to a relatively high temperature (e.g., approximately 200° C.). Therefore, from the viewpoint of safety, it is desirable that a user or a service person draws the fixing device out of the main body for operation only after the fixing device is cooled by a cooling device. The problem here is that, in the above-described configuration in which the cooling device is provided at the main body, the fixing device is not cooled by the cooling device once it is removed from the main body.

Alternatively, for the above-described another configuration as well, in which the cooling section of the cooling device is provided at the main body while the heat-receiving section of the cooling device is integrally provided with the fixing device, the heat-receiving section is separated from the cooling section when the fixing device is detached from the main body. As a result, since the heat-receiving-section channel and the circulation path are separated, the fixing device is not cooled after being detached from the main body. Consequently, the temperature of the fixing device may be maintained relatively high during servicing operation, posing a danger when a user or a service man touches the fixing device.

Alternatively, it is conceivable that the cooling section is also integrally provided with the fixing device so that a coolant is circulated to cool the fixing device with the fixing device detached from the main body. However, such a configuration may increase the size of the fixing device, reducing the performance of clearing a paper jam due to the opening and closing of a cover of the fixing device. Further, such a configuration may require greater strength of the fixing device housing, a requirement that conflicts with market demand for more compact and lightweight designs.

Further, the above-described challenge is not limited to the fixing device and may also arise in a configuration in which any other device in the imaging unit, such as a developing device, which is located near the fixing device and whose temperature is raised by heat of the fixing device, is to be detachable from the main body.

SUMMARY OF THE INVENTION

The present disclosure provides an image forming apparatus including a cooling section to cool a heat generator installed in a main body or any other device whose temperature is raised by heat of the heat generator to enhance safety in clearing a paper jam or performing servicing operation.

In one illustrative embodiment, an image forming apparatus, comprising a main body, a cooling device, and a coupling assembly. The cooling device cools as a cooling target one of a heat generator and a neighboring portion whose temperature is raised by heat of the heat generator. The cooling device includes a heat-receiving section forming a heat-receiving-section channel through which a coolant flows to absorb heat from the cooling target, a cooling section to cool the coolant, and a circulation path to circulate the coolant between the heat-receiving section and the cooling section by transporting the coolant from the heat-receiving section to the cooling section, cooling the coolant at the heat-receiving section, and transporting the coolant back to the heat-receiving section. The cooling target is detachable from the main body, and the heat-receiving section is detachable from the main body along with the cooling target. The cooling section is provided at the main body. The coupling assembly connects the heat-receiving-section channel and the circulation path to circulate the coolant between the heat-receiving section and the cooling section whether with the cooling target installed in or detached from the main body.

In another illustrative embodiment, an image forming apparatus, comprising a main body, a cooling device, and coupling means. The cooling device cools as a cooling target one of a heat generator and a neighboring portion whose temperature is raised by heat of the heat generator. The cooling device includes a heat-receiving section forming a heat-receiving-section channel through which a coolant flows to absorb heat from the cooling target, a cooling section to cool the coolant, and a circulation path to circulate the coolant between the heat-receiving section and the cooling section by transporting the coolant from the heat-receiving section to the cooling section, cooling the coolant at the heat-receiving section, and transporting the coolant back to the heat-receiving section. The cooling target is detachable from the main body, and the heat-receiving section is detachable from the main body along with the cooling target. The cooling section is provided at the main body. The coupling means connects the heat-receiving-section channel and the circulation path to circulate the coolant between the heat-receiving section and the cooling section whether with the cooling target installed in or detached from the main body.

BRIEF DESCRIPTION OF THE DRAWINGS

A more complete appreciation of the disclosure and many of the attendant advantages thereof will be readily acquired as the same becomes better understood by reference to the following detailed description when considered in connection with the accompanying drawings, wherein.

Figure 1:
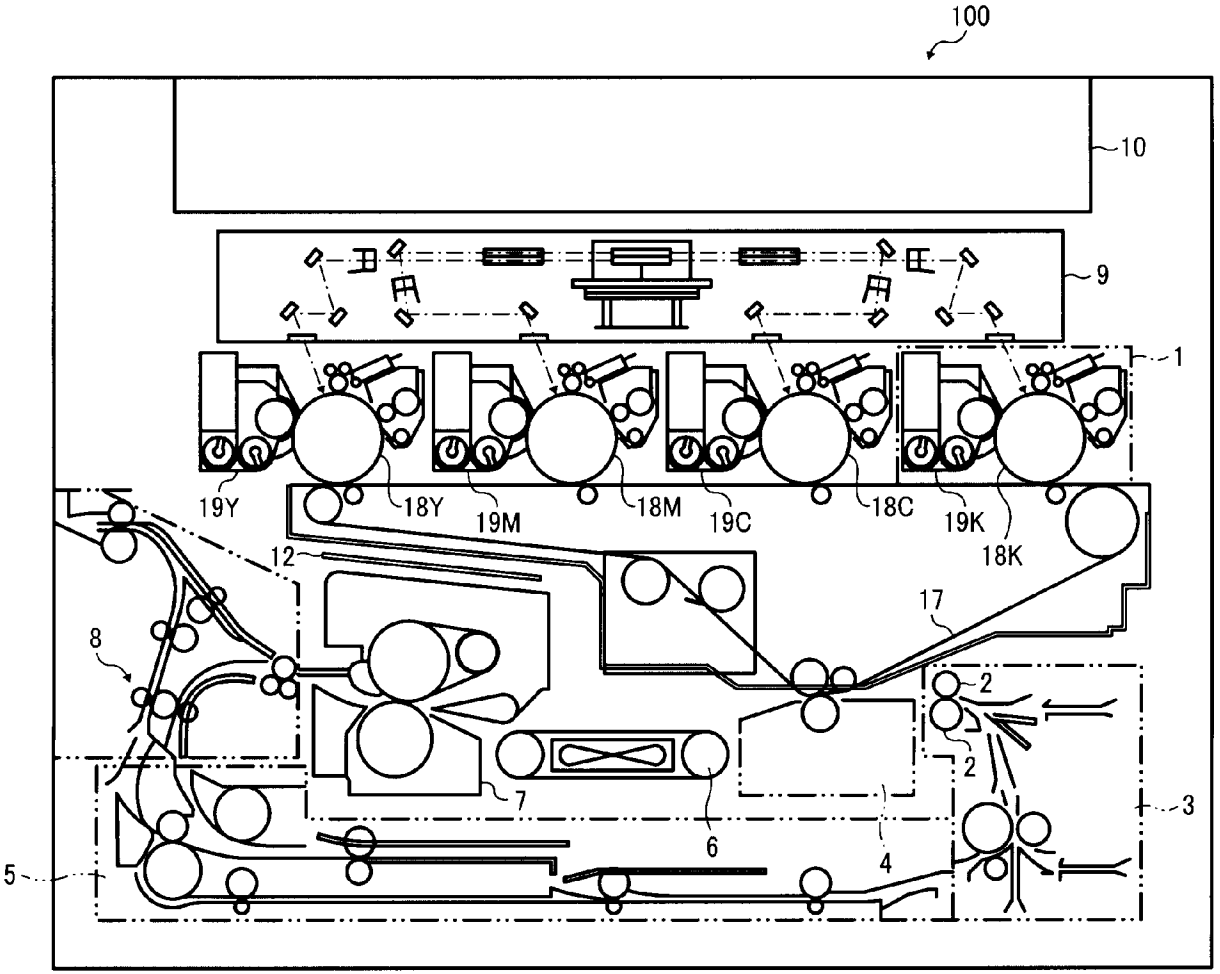
FIG. 1 is a schematic view illustrating a configuration of an image forming apparatus according to an illustrative embodiment.

The accompanying drawings are intended to depict illustrative embodiments of the present disclosure and should not be interpreted to limit the scope thereof. The accompanying drawings are not to be considered as drawn to scale unless explicitly noted.

DETAILED DESCRIPTION OF ILLUSTRATIVE EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the illustrative embodiments are described with technical limitations with reference to the attached drawings, such description is not intended to limit the scope of the present invention and all of the components or elements described in the illustrative embodiments of this disclosure are not necessarily indispensable to the present invention.

Below, a description is given of illustrative embodiments according to the present disclosure with reference to the drawings.

FIG. 1 is a schematic view illustrating a configuration of an image forming apparatus 100 according to an illustrative embodiment.

In FIG. 1, the image forming apparatus 100 has a plurality of imaging units 1 including photoconductors 18Y, 18M, 18C, and 18K and developing devices 19Y, 19M, 19C, and 19K, respectively. The photoconductors 18Y, 18M, 18C, and 18K serving as image bearing bodies are arranged side by side. Above the imaging units 1 is disposed an exposure device 9 to form electrostatic latent images. At an upper portion of the image forming apparatus 100 is disposed a reading device 10 to scan a document placed on a contact glass. Below the imaging units 1 is disposed an intermediate transfer belt 17 serving as an intermediate transfer body. The intermediate transfer belt 17 is extended between a plurality of support rollers and rotates in a clockwise direction in FIG. 1. At the side opposite to the imaging unit 1 is disposed a secondary transfer device 4 below the intermediate transfer belt 17. At a downstream side relative to the secondary transfer device 4 in the rotation direction of the intermediate transfer belt 17 is disposed a belt cleaner to remove residual toner remaining on the intermediate transfer belt 17. In FIG. 1, at a left side of the secondary transfer device 4 is disposed a fixing device 7 having a heating roller. The heating roller includes a heat generator to fix a toner image transferred on a sheet. Between the secondary transfer device 4 and the fixing device 7 is disposed a conveyance belt 6 to convey the sheet having the transferred toner image to the fixing device 7. At a lower portion of the image forming apparatus 100 is disposed a sheet feed unit 3 to feed a sheet, which is separated sheet by sheet from a sheet container, to the secondary transfer device 4. Further, a sheet ejection unit 8 is provided to convey the sheet having passed through the fixing device 7 to an external portion of the image forming apparatus 100 or a duplex unit 5.

When a document is copied with the image forming apparatus 100, the reading device 10 scans the document while the intermediate transfer belt 17 rotates in the clockwise direction in FIG. 1. Simultaneously, in the imaging unit 1, the photoconductors 18Y, 18M, 18C, and 18K are exposed using the exposure device 9 in accordance with respective color information of yellow, magenta, cyan, and black based on the scanned content of the document. As a result, latent images are formed on the respective photoconductors 18Y, 18M, 18C, and 18K. The developing devices 19Y, 19M, 19C, and 19K develop the latent images on the photoconductors 18Y, 18M, 18C, and 18K, respectively, into visible images to form single-color toner images (visible images). The toner images on the photoconductors 18Y, 18M, 18C, and 18K are sequentially transferred so as to overlap one on another on the intermediate transfer belt 17. As a result, a composite toner image is formed on the intermediate transfer belt 17.

In parallel with the above-described formation of toner images, sheets are fed sheet by sheet from the sheet container and abutted against registration rollers 2. The registration rollers 2 rotate in synch with the formation of the composite toner image on the intermediate transfer belt 17 to send the sheet to a secondary transfer position, that is, a nip between the intermediate transfer belt 17 and the secondary transfer device 4. Thus, the secondary transfer device 4 transfers the toner image on the sheet. The sheet having the transferred toner image is conveyed with the conveyance belt 6 to the fixing device 7. The fixing device 7 fixes the toner image on the sheet by heat and pressure and forwards the sheet to the sheet ejection unit 8. The sheet ejection unit 8 switches the direction of a switching hook to guide the sheet to the duplex unit 5 or, for example, a sheet ejection tray provided at the external portion of the image forming apparatus 100. In the duplex unit 5, the sheet is reversed and sent back to the secondary transfer position. When a desired image is formed on the reverse side of the sheet, the sheet ejection unit 8 ejects the sheet to the sheet ejection tray. After the image transfer operation, the belt cleaner removes residual toner remaining on the intermediate transfer belt 17 to prepare for subsequent image formation of the imaging units 1.

In the image forming apparatus 100, the fixing device 7 is fitted under the intermediate transfer belt 17 in connection with an increased density of components, which results from a reduced size of the image forming apparatus 100. In the image forming apparatus 100 of FIG. 1, the intermediate transfer belt 17 is bent to cover the top face and the right-side face of the fixing device 7. The intermediate transfer belt 17 is also bent so that the belt cleaner is located between the right-side face and the intermediate transfer belt 17. Such a configuration can reduce both height and width of the image forming apparatus 100.

However, when the fixing device 7 is disposed near the intermediate transfer belt 17, the intermediate transfer belt 17 is thermally affected by the fixing device 7 including the heat generator, which might cause an image failure such as color misalignment. As the operation speed of the image forming apparatus 100 increases, the amount of heat generated in the image forming apparatus 100 also increases, which may more easily cause such a failure. Alternatively, in duplex printing, since the sheet heated in the fixing device 7 passes through the duplex unit 5 and repeatedly contacts the intermediate transfer belt 17 at the secondary transfer position, the heat transferred from the sheet raises the temperature of the intermediate transfer belt 17, causing a more severe condition against image formation. Such heat is transferred to the photoconductors 18Y, 18M, 18C, and 18K in contact with the intermediate transfer belt 17 and further to the developing devices 19Y, 19M, 19C, and 19K, which may more easily cause an image failure due to deformation of the intermediate transfer belt 17 or other failures such as toner solidification.

Hence, the image forming apparatus 100 includes a cooling device to cool the fixing device 7, a heat generation source, and the intermediate transfer belt 17 disposed near the fixing device 7. For such a cooling device, a method of performing air-cooling and heat insulation by using a duct provided between the fixing device 7 and the intermediate transfer belt 17 might be employed. However, since the above-described reduced size of the image forming apparatus 100 results in a reduced space between the fixing device 7 and the intermediate transfer belt 17, it may be difficult to provide such a duct between the fixing device 7 and the intermediate transfer belt 17. Alternatively, although a conventional cooling device employs a heat pipe rather than such a duct, such a conventional cooling device has not properly coped with an increased amount of generated heat and an increased density of components within the image forming apparatus 100. Since such a heat pipe transports heat by steam, a heat radiating section may be located higher than a heat-receiving section. If such a heat pipe has a bent portion, the efficiency of heat radiation may be significantly impaired at the bent portion. For such reasons, in the above-described cooling device with a heat pipe, the positioning of a heat radiating section may be severely restricted, preventing effective use of the heat pipe.

Hence, according to the present illustrative embodiment, the image forming apparatus 100 includes a cooling device 11 employing a fluid cooling method.

Figure 2:
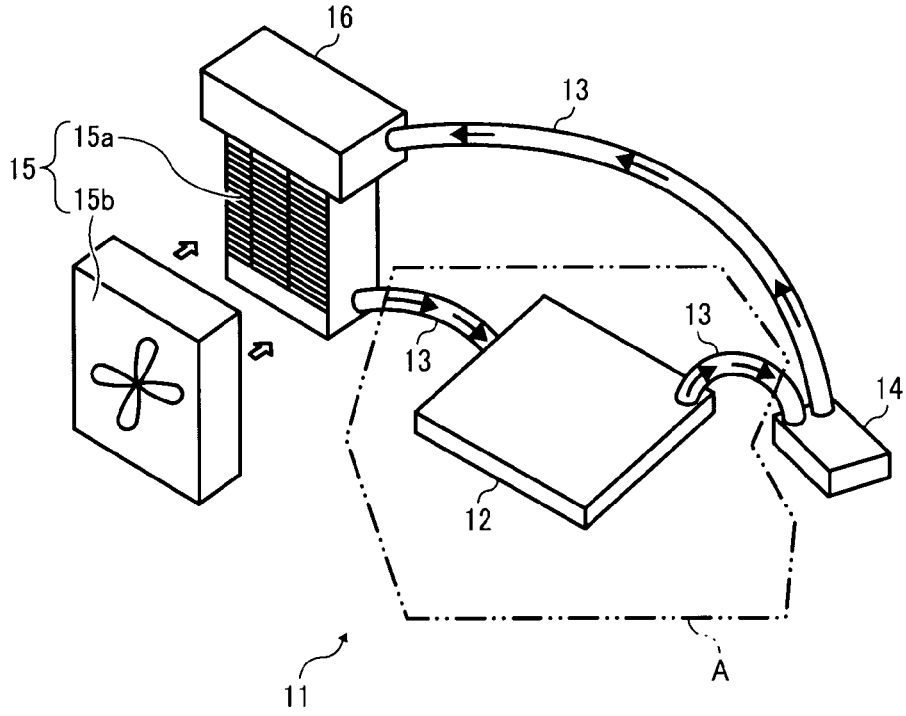
FIG. 2 is a schematic view illustrating a basic configuration of a cooling device employing a fluid cooling method.

FIG. 2 is a schematic view illustrating a basic configuration of the cooling device 11. The cooling device 11 includes a heat absorber 12 serving as a heat-receiving section, a circulation path 13 to circulate a coolant, a pump 14, a cooling section 15 including a radiator 15*a* and a cooling fan 15*b*, and a reserve tank 16. The heat absorber 12 is made of highly-conductive material, and a channel through which the coolant flows to absorb heat from a cooling target A is attached to or embedded in the heat absorber 12. Alternatively, the heat absorber 12 itself may form such a channel. The heat absorber 12 receives heat from a heat source and effectively transfers the heat to the coolant in the channel. The circulation path 13 transports the coolant having taken the heat from the heat absorber to the cooling section 15, cools the coolant at the cooling section 15, and transports the coolant back to the heat absorber 12. Thus, the coolant is circulated between the heat absorber 12 and the cooling section 15. The circulation path 13 employs an aluminum tube, a rubber tube, and/or other material tubes according to used positions. In the cooling section 15, the radiator 15*a* conducts and radiates the heat to and from the coolant via a container made of highly-conductive material, such as aluminum, containing the coolant transported from the circulation path 13. The cooling fan 15*b* performs a forced or natural air-cooling operation depending on the amount of heat radiation. The pump 14 is a driving source for circulating the coolant between the heat absorber 12 and the cooling section 15 as indicated by arrows illustrated in FIG. 2. The reserve tank 16 is a tank to store the coolant. The coolant is a heat transport medium for transporting the heat received by the heat absorber 12 to the radiator 15*a*. In the present embodiment, a propylene-glycol antifreeze solution or the like is used for the coolant. The heat absorber 12 described above is disposed along a top face of the fixing device 7 between the intermediate transfer belt 17 and the fixing device 7 (see FIG. 1).

The fixing device 7 is detachable from a main body of the image forming apparatus 100 to clear a paper jam or perform servicing operation. Further, as described above, the heat absorber 12 of the cooling device 11 is disposed along the top cover of the fixing device 7 and is detached from the main body along with the fixing device 7.

Figure 3:
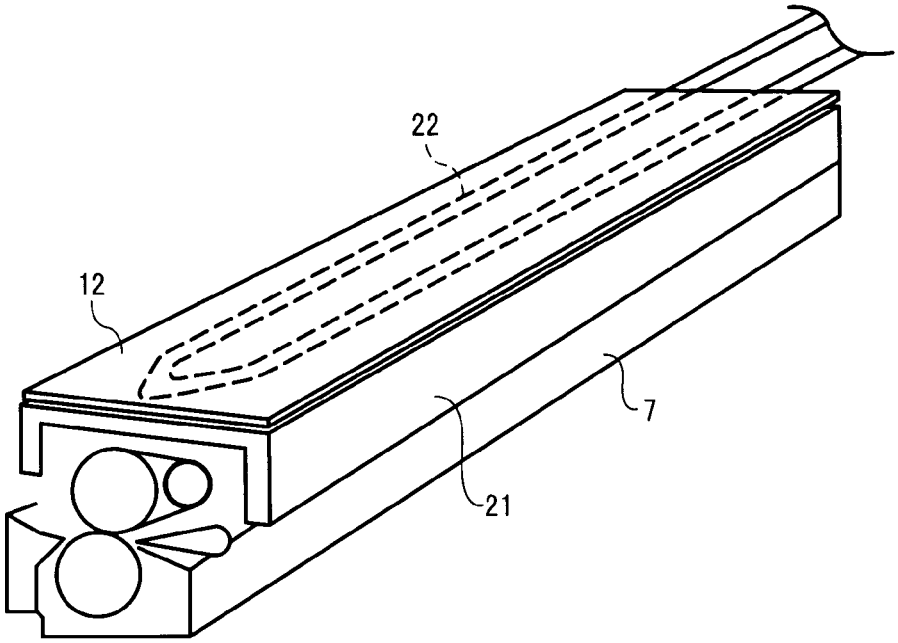
FIG. 3 is a perspective view illustrating a state in which a fixing device is detached from a main body of the image forming apparatus.

FIG. 3 is a perspective view illustrating a state in which the fixing device 7 is detached from the main body of the image forming apparatus 100. Components other than the heat absorber 12 of the cooling device 11, that is, the circulation path 13, the pump 14, the cooling section 15 including the radiator 15*a* and the cooling fan 15*b*, and the reserve tank 16 are provided at the main-body side of the image forming apparatus 100 and are not to be detachable from the main body. Here, the image forming apparatus 100 has a configuration in which a heat-receiving-section channel 22 formed in the heat absorber 12 to flow the coolant is connected to the circulation path 13 provided at the main-body side when the heat absorber 12 is detached from the main body along with the fixing device 7. As a result, the heat of the fixing device 7 is conducted to the coolant in the heat-receiving-section channel 22 via a cover 21, and the coolant is transported through the circulation path 13 to the radiator 15 and radiates the heat at the radiator 15. Accordingly, even when the fixing device 7 is detached from the main body of the image forming apparatus 100, the image forming apparatus 100 can continuously cool the fixing device 7 to reduce the temperature of the fixing device 7, allowing a user or a service person to more safely clear a paper jam and perform servicing operation. As illustrated in FIGS. 1 and 3, the cover 21 of the fixing device 7 is disposed away from the heat absorber 12 with a gap to prevent the fixing device 7 from being overcooled.

It is to be noted that the configuration of the image forming apparatus 100 is not limited to the above-described configuration and, for example, when the cooling device 11 is to control temperature, the heat absorber 12 may directly contact the cover 21 of the fixing device 7. Alternatively, to facilitate servicing of the fixing device 7, the fixing device 7 and the heat absorber 12 may be detachable from each other after being detached from the main body.

Next, a description is given of a coupling assembly to connect the heat-receiving-section channel 22 and the circulation path 13 with the heat absorber 12 detached from the main body.

Figure 4:
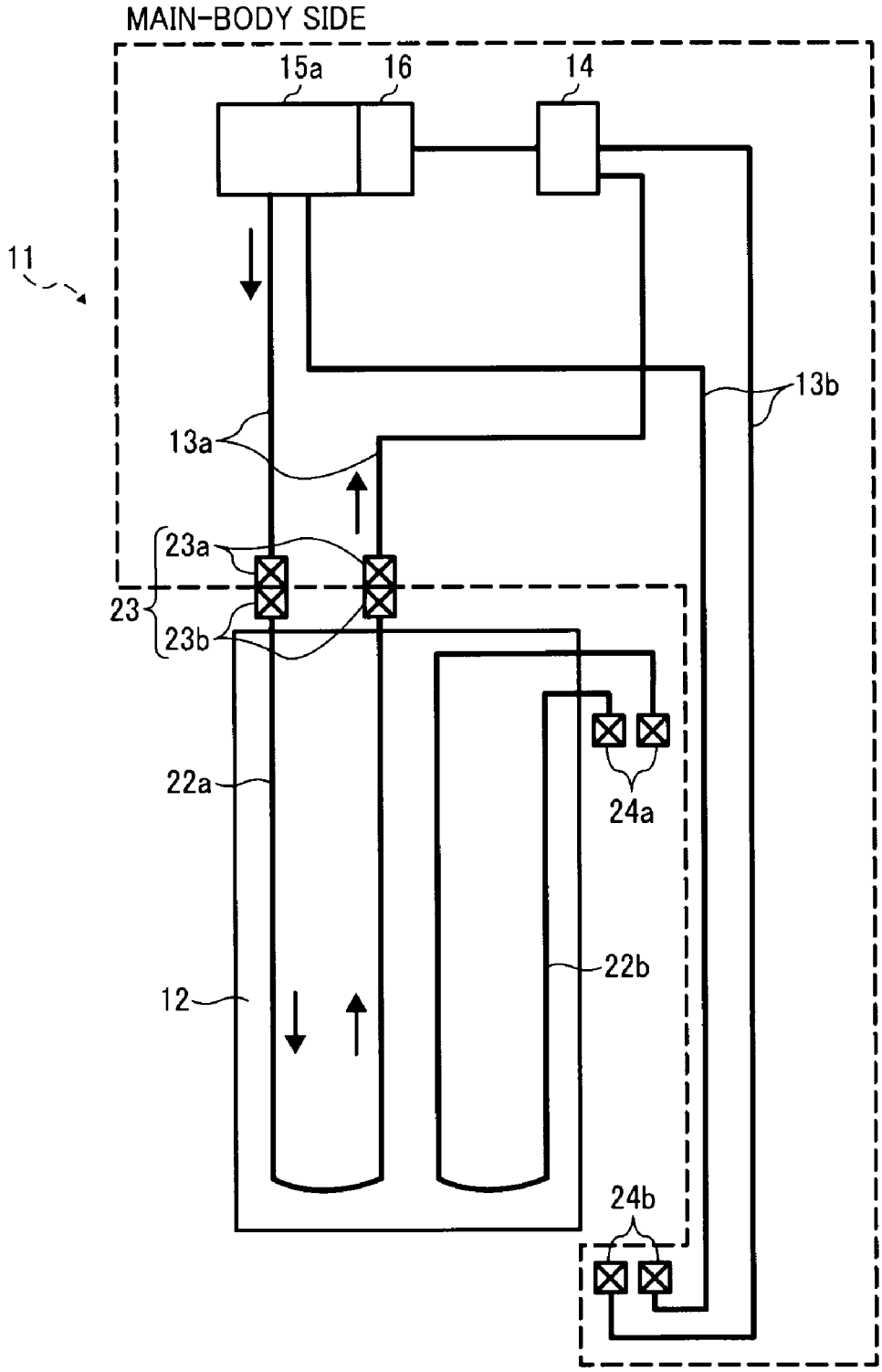
FIG. 4 is a schematic view illustrating a circulation system of a coolant when a fixing device is installed in a main body of an image forming apparatus according to an illustrative embodiment.
Figure 5:
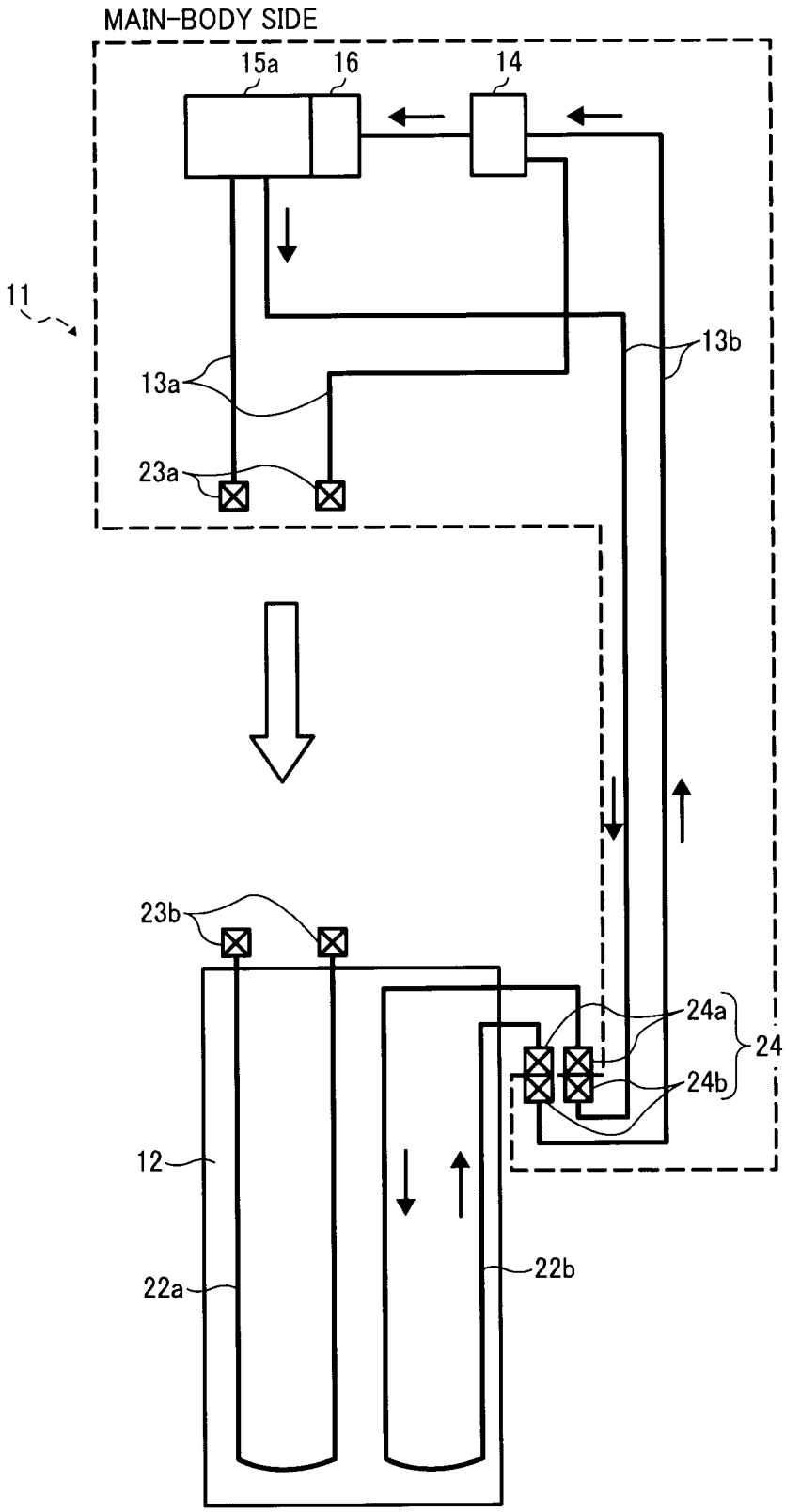
FIG. 5 is a schematic view illustrating the circulation system of the coolant when the fixing device is detached from the main body of the image forming apparatus.

FIG. 4 is a schematic view illustrating a circulation system of the coolant with a fixing device 7 installed in the main body of the image forming apparatus 100 according to the present illustrative embodiment. FIG. 5 is a schematic view illustrating the circulation system of the coolant with the fixing device 7 detached from the main body of the image forming apparatus 100.

In FIG. 4, the main-body side demarcated by a dashed line indicates an area in which components are provided at the main-body side of the image forming apparatus 100 and are not to be detachable from the main body. As the circulation path 13 described above, two lines of a first circulation line 13*a* and a second circulation line 13*b* are provided at the main-body side. As the heat-receiving-section channel 22 through which the coolant flows, two lines of a first heat-receiving-section line 22*a* and a second heat-receiving-section line 22*b* are provided at the heat absorber 12. As illustrated in FIG. 4, first coupling portions 23*a* are provided at ends of the first circulation line 13*a*, and second coupling portions 23*b* are provided at ends of the first heat-receiving-section line 22*a*. The first coupling portions 23*a* are detachably coupled to the corresponding second coupling portions 23*b* to form a first coupler 23. Further, third coupling portions 24*a* are provided at ends of the second circulation line 13*b*, and fourth coupling portions 24*b* are provided at ends of the second heat-receiving-section line 22*b*. The third coupling portions 24*a* are detachably coupled to the fourth coupling portions 24*b* to form a second coupler 24.

As illustrated in FIG. 4, when the fixing device 7 is installed in the main body, the first coupler 23 is coupled. On coupling, the first coupler 23 is opened to serve as a first connector to connect the first circulation line 13*a* and the first heat-receiving-portion line 22*a* when the fixing device 7 is installed in the main body. By contrast, as illustrated in FIG. 5, when the fixing device 7 is detached from the main body, the first coupler 23 is decoupled to separate the first circulation line 13*a* from the first heat-receiving-section line 22*a*. Instead, the second coupler 24 is coupled. On coupling, the second coupler 24 is opened to serve as a second connector to connect the second circulation line 13*b* and the second heat-receiving-section line 22*b* when the fixing device 7 is detached from the main body. Each of the first coupler 23 and the second coupler 24 is to close on separation, preventing the coolant from leaking when the first circulation line 13*a* and the second circulation line 13*b* are separated from the first heat-receiving-section line 22*a* and the second heat-receiving-section line 22*b*, respectively. The first coupling portions 23*a*, the second coupling portions 23*b*, the third coupling portions 24*a*, and the fourth coupling portions 24*b* are supported by support members to securely couple without being shifted by the install and drawing operations of the fixing device 7.

As described above, for the present illustrative embodiment, the cooling device 11 includes the first and second circulation lines 13*a* and 13*b* as the circulation path 13, and the first and second heat-receiving-section lines 22*a* and 22*b* as the heat-receiving-section channel 22. When the fixing device 7 is installed in the main body of the image forming apparatus 100, the first circulation line 13*a* and the first heat-receiving-section line 22*a* are coupled via the first coupler 23 to circulate the coolant. Thus, whether the fixing device 7 is installed in or detached from the main body, the fixing device 7 can be continuously cooled.

Figure 6:
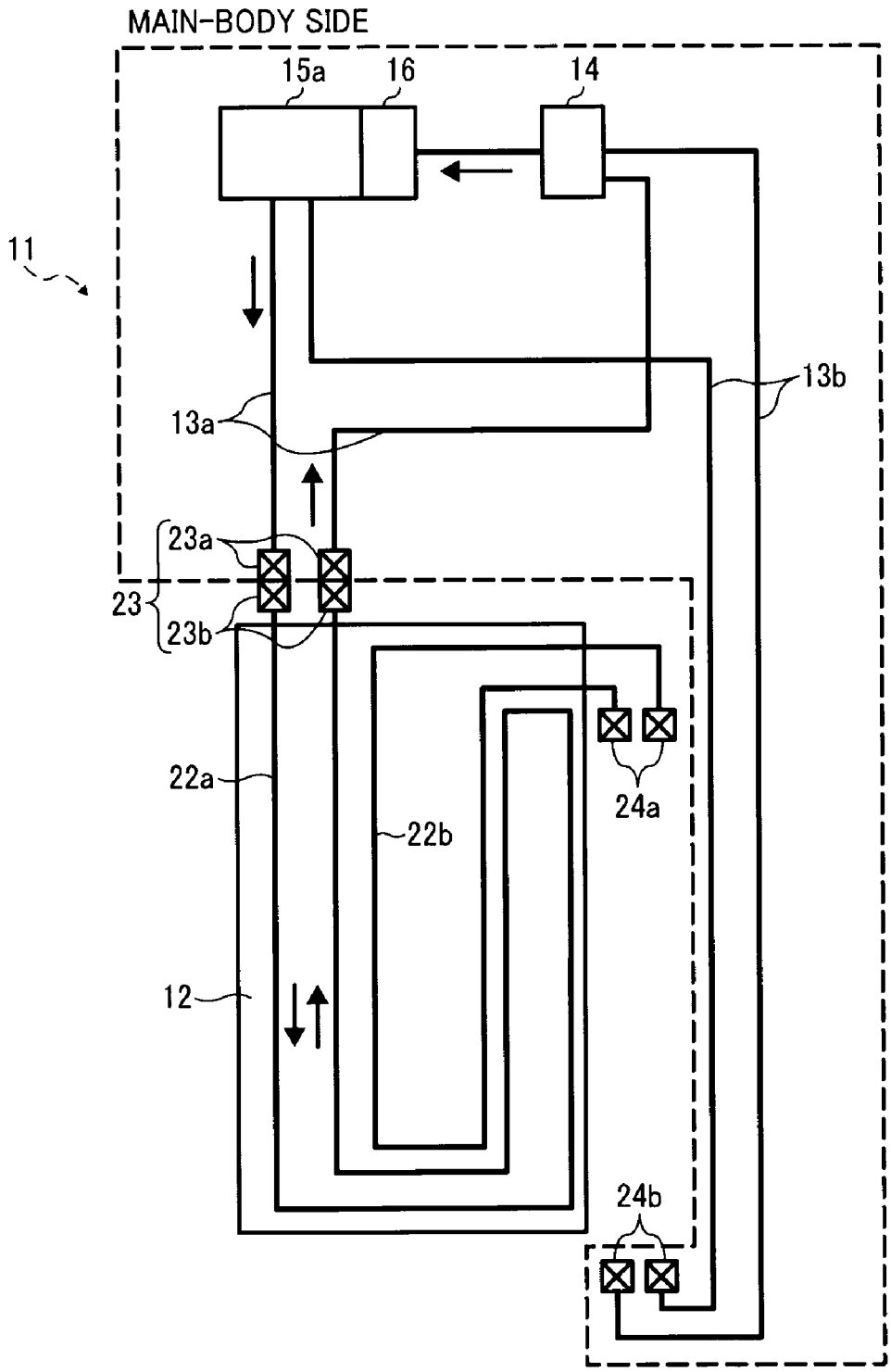
FIG. 6 is a schematic view illustrating a modification of the circulation system of FIGS. 4 and 5.

It is to be noted that the positions of the first heat-receiving-section line 22*a* and the second heat-receiving-section line 22*b* are not limited to those illustrated in FIG. 4. Thus, for example, as illustrated in FIG. 6 the first heat-receiving-section line 22*a* and the second heat-receiving-section line 22*b* may be horizontally extended across the fixing device 7, allowing the fixing device 7 to be uniformly cooled.

Figure 7:
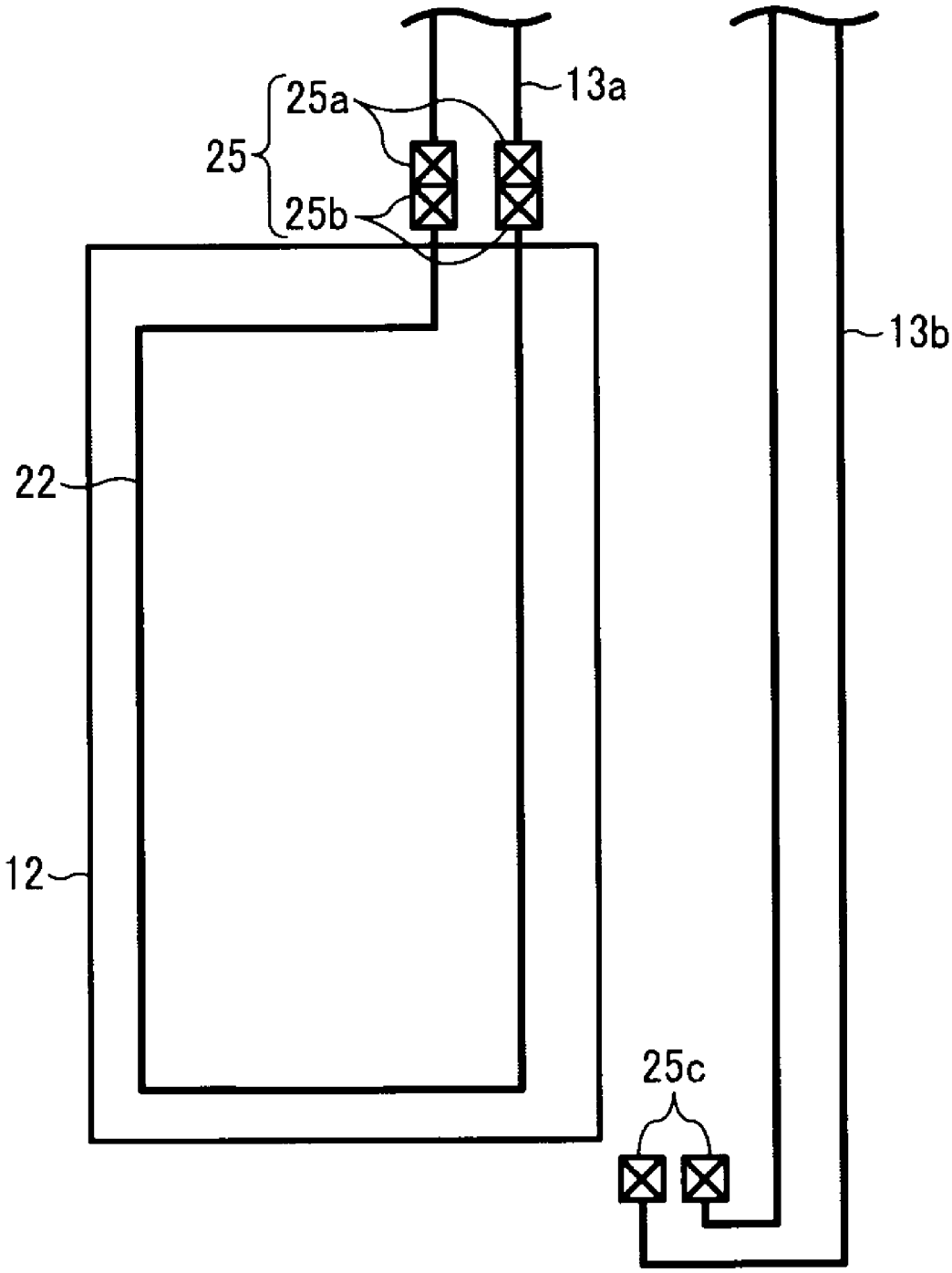
FIG. 7 is a schematic view illustrating a circulation system of a coolant when a fixing device is installed in a main body of an image forming apparatus according to an illustrative embodiment.
Figure 8:
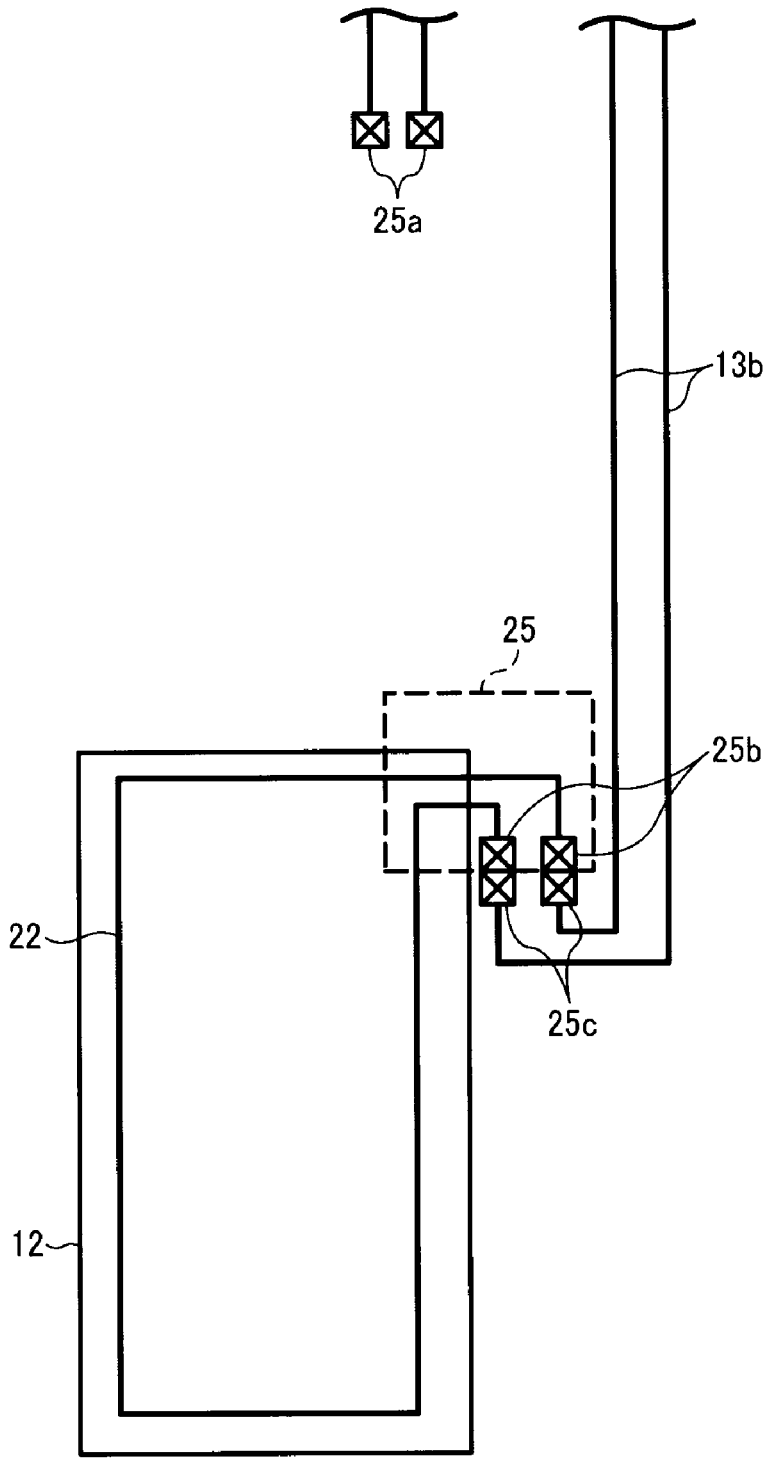
FIG. 8 is a schematic view illustrating the circulation system of the coolant when the fixing device is detached from the main body of the image forming apparatus.

FIG. 7 is a schematic view illustrating a circulation system of a coolant in with a fixing device installed in a main body of an image forming apparatus 100 according to another illustrative embodiment. FIG. 8 is a schematic view illustrating the circulation system of the coolant with the fixing device detached from the main body. This illustrative embodiment is a modification of the above-described illustrative embodiment illustrated in FIGS. 4 and 5, and redundant descriptions of components and configurations similar to those of the illustrative embodiment 1 are omitted below.

For the present illustrative embodiment of FIGS. 7 and 8, two lines of a first circulation line 13*a* and a second circulation line 13*b* are provided as the circulation path 13. A heat absorber 12 includes one line of a heat-receiving-section channel 22 as a channel through which the coolant flows. First coupling portions 25*a* and third coupling portions 25*c* are provided at ends of the first circulation line 13*a* and the second circulation line 13*b*, respectively. Second coupling portions 25*b* are provided at ends of the heat-receiving-section channel 22. For the present illustrative embodiment of FIGS. 7 and 8, portions of the heat-receiving-section channel 22 near the second coupling portions 25*b* may be formed of, for example, rubber tubes so that such neighboring portions can deform when a handle is rotated or drawn to change the orientation of the second coupling portions 25*b* (see FIGS. 7 and 8). Accordingly, as illustrated in FIG. 7, with the fixing device 7 installed in the main body, the first coupling portions 25*a* are coupled to the second coupling portions 25*b*. Thus, the first coupling portions 25*a* and the second coupling portions 25*b* serve as a coupler (connector) 25 to connect the first circulation line 13*a* and the heat-receiving-section channel 22. By contrast, as illustrated in FIG. 8, with the fixing device 7 detached from the main body, the first coupling portions 25*a* and the second coupling portions 25*b* are decoupled to separate the first circulation line 13*a* from the heat-receiving-section channel 22. At the same time, the orientation of the second coupling portions 25*b* is changed to couple the third coupling portions 25*c* to the second coupling portions 25*b*. Thus, the third coupling portions 25*c* and the second coupling portions 25*b* serve as the coupler 25 to connect the second circulation line 13*b* and the heat-receiving-section channel 22.

As described above, for the illustrative embodiment of FIGS. 7 and 8, the image forming apparatus 100 includes the two lines of the circulation lines 13*a* and 13*b* and one line of the heat-receiving-section channel 22. With the fixing device 7 installed in the main body, the first circulation line 13*a* and the heat-receiving-section channel 22 are connected via the first coupling portions 25*a* and the second coupling portions

25*b* to circulate the coolant. By contrast, with the fixing device 7 detached from the main body, the second circulation line 13*b* and the heat-receiving-section channel 22 are connected via the second coupling portions 25*b* and the third coupling portions 25*c* to circulate the coolant. Such a configuration allows the fixing device 7 to be continuously cooled whether the fixing device 7 is installed in or detached from the main body of the image forming apparatus 100. Further, the configuration of the present illustrative embodiment can save space and reduce cost compared to the configuration of the above-described illustrative embodiment illustrated in FIGS. 4 and 5.

Figure 9:
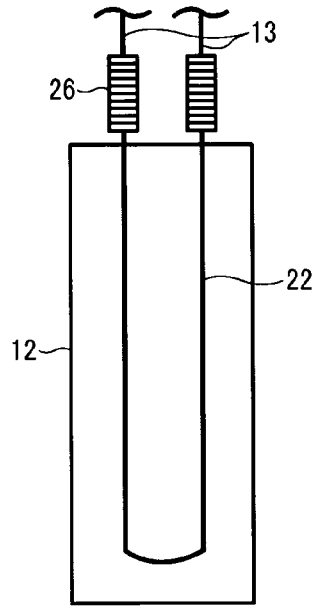
FIG. 9 is a schematic view illustrating a circulation system of a coolant when a fixing device is installed in a main body of an image forming apparatus according to an illustrative embodiment.
Figure 10:
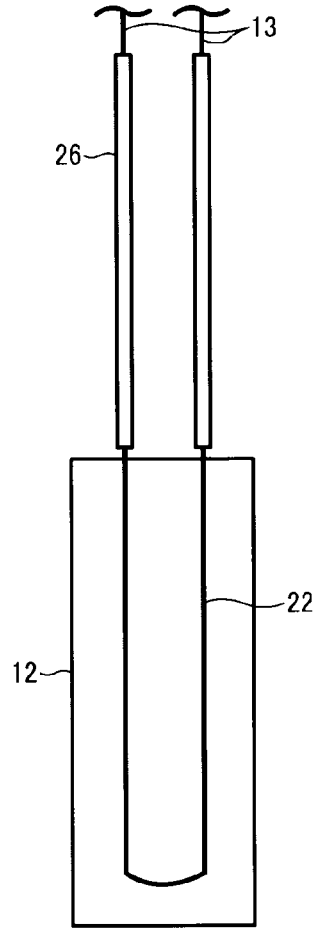
FIG. 10 is a schematic view illustrating the circulation system of the coolant when the fixing device is detached from the main body of the image forming apparatus.

FIG. 9 is a schematic view illustrating a circulation system of a coolant with a fixing device installed in a main body of an image forming apparatus 100 according to still another illustrative embodiment. FIG. 10 is a schematic view illustrating the circulation system of the coolant with the fixing device detached from the main body.

For the present illustrative embodiment illustrated in FIGS. 9 and 10, each of a circulation path 13 and a heat-receiving-section channel 22 forms on line. Between the circulation path 13 and the heat-receiving-section channel 22 are provided coupling members 26 having extensibly contractible portions (e.g., accordion-shaped portions in FIGS. 9 and 10). When the fixing device 7 is detached from the main body, the extensibly contractible portions are extended so that, as illustrated in FIG. 10, the connection between the circulation path 13 and the heat-receiving-section channel 22 is maintained without being broken.

Figure 11:
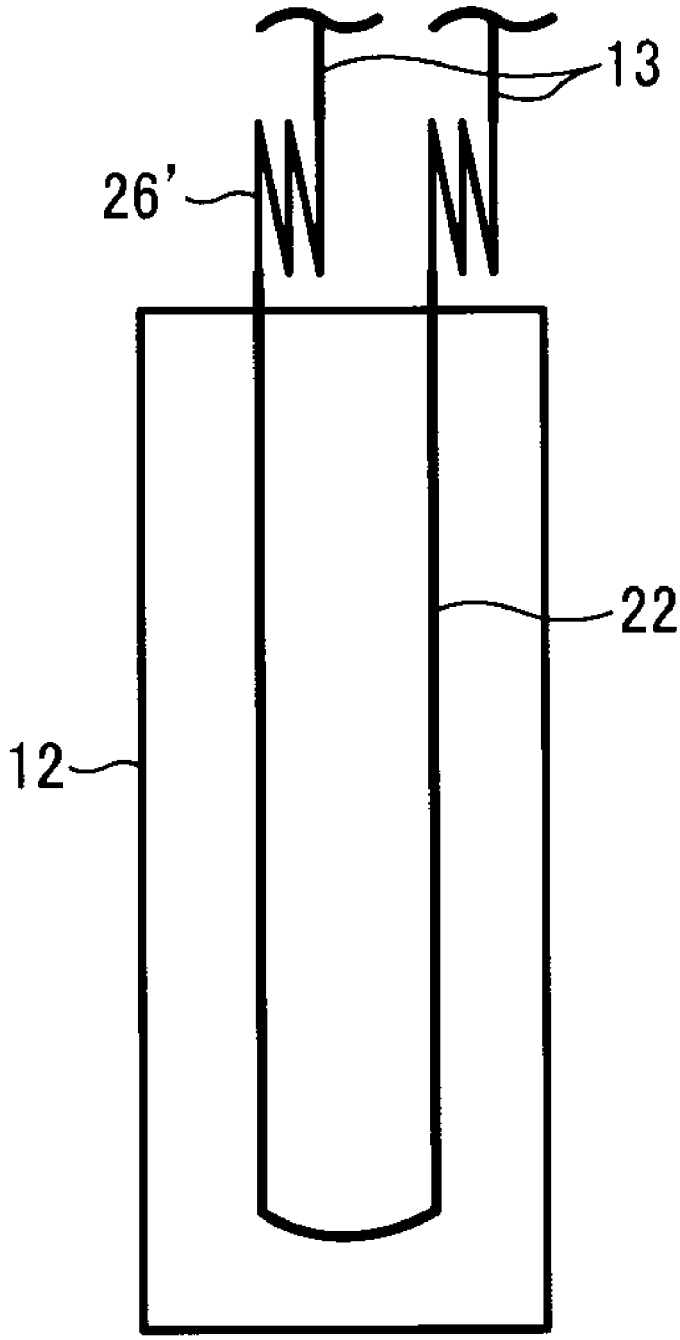
FIG. 11 is a schematic view illustrating a modification of the circulation system of FIGS. 9 and 10.

FIG. 11 is a schematic view illustrating a modification of the above-described illustrative embodiment illustrated in FIGS. 9 and 10. In FIG. 11, coupling members 26' having extensibly collapsible portions are provided between the circulation path 13 and the heat-receiving-section channel 22. When the fixing device 7 is detached from the main body, the extensibly collapsible portions are extended so that the connection between the circulation path 13 and the heat-receiving-section channel 22 is maintained unbroken.

As described above, for the present illustrative embodiment of FIGS. 9 and 10 (or FIG. 11), each of the circulation path 13 and the heat-receiving-section channel 22 is formed of a single line and, with the fixing device 7 detached from the main body, the circulation path 13 and the heat-receiving-section channel 22 are connected via the coupling members having an extensible portion, such as an extensibly contractible portion or an extensibly collapsible portion, to continue to circulate the coolant. Accordingly, with the present illustrative embodiment, such a simple configuration allows the fixing device 7 to be continuously cooled while achieving space saving and cost reduction of the image forming apparatus.

Although the above-described illustrative embodiments are described with reference to a case in which the fixing device 7 is a cooling target of the cooling device 11, it is to be noted that the cooling target is not limited to the fixing device 7. For example, the present invention is applicable to an image forming apparatus including a cooling device for cooling a developing device as a cooling target to prevent an increase in temperature of the developing device, thermal effects of the developing device on neighboring components, and an increase in temperature of the neighboring components. Accordingly, when a user or a service person performs servicing operation with the developing device detached from the main body of the image forming apparatus, the above-described configuration can maintain the developing device at low temperatures, thus enhancing the safety of the image forming apparatus. The above-described configuration can also prevent image failures, such as streaks, caused by an increase in temperature of the developing device. The present invention is also applicable to a device (e.g., a conveyance roller unit or a sheet ejection unit) to be detachable from the main body of the image forming apparatus.

As described above, in one of the above-described illustrative embodiments, the image forming apparatus 100 includes the fixing device 7 detachable from the main body and the cooling device 11. The cooling device 11 includes the heat absorber 12 serving as a heat-receiving section that includes the heat-receive-portion channel 22 through which the coolant flows to absorb heat from the fixing device 7, the cooling section 15 to cool the coolant, and the circulation path 13 to circulate the coolant between the heat absorber 12 and the cooling section 15 by transporting the coolant from the heat absorber 12 to the cooling section 15, cooling the coolant in the cooling section 15, and transporting the coolant back to the heat absorber 12. The heat absorber 12 of the cooling device 11 is integrally provided with the fixing device 7, while the cooling section 15 is provided at the main body. Further, the coupling assembly to connect the heat-receive-portion channel 22 and the circulation path 13 is provided so that the coolant circulates whether the fixing device 7 is installed in or detached from the main body. Accordingly, not only when the fixing device 7 is installed in the main body but also when the fixing device 7 is detached from the main body, the heat-receive-portion channel 22 and the circulation path 13 are connected via the coupling assembly, allowing the fixing device 7 to be continuously cooled. As a result, with the temperature of the fixing device 7 maintained low, a user or a service person can clear a paper jam or perform servicing operation, resulting in an enhanced safety. Further, providing the cooling section 15 at the main body can prevent upsizing of the fixing device.

In another illustrative embodiment, the image forming apparatus includes two lines of the first circulation line 13*a* and the second circulation line 13*b* at the main body. Two lines of the first heat-receiving-section line 22*a* and the second heat-receiving-section line 22*b* are provided in the heat absorber 12. With the fixing device 7 installed in the main body, the first circulation line 13*a* and the first heat-receiving-section line 22*a* are connected via the first coupler 23. When the first circulation line 13*a* and the first heat-receiving-section line 22*a* are connected, the first coupler 23 is opened to serve as a connector that connects the first circulation line 13*a* and the first heat-receiving-section line 22*a* with the fixing device 7 installed in the main body. By contrast, with the fixing device 7 detached from the main body, the first coupler 23 is decoupled to separate the first circulation line 13*a* from the first heat-receiving-section line 22*a* and, instead, the second circulation line 13*b* and the second heat-receiving-section line 22*b* are connected via the second coupler 24. When the second circulation line 13*b* and the second heat-receiving-section line 22*b* are connected, the second coupler 24 is opened to serve as a connector to connect the second circulation line 13*b* and the second heat-receiving-section line 22*b* with the fixing device 7 detached from the main body. Accordingly, whether the fixing device 7 is installed in or detached from the main body, the fixing device 7 can be continuously cooled.

In one of the above-described illustrative embodiments, the cooling device 11 includes two lines of the first circulation line 13*a* and the second circulation line 13*b* and one line of the heat-receive-portion channel 22. With the fixing device 7 installed in the main body, the first circulation line 13*a* and the heat-receive-portion channel 22 are connected via the first coupling portions 25*a* and the second coupling portions 25*b* to circulate the coolant. By contrast, with the fixing device 7 detached from the main body, the second circulation line 13*b* and the heat-receive-portion channel 22 are connected via the second coupling portions 25*b* and the third coupling portions 25*c* to circulate the coolant. Thus, whether the fixing device 7 is installed in or detached from the main body, such a configuration allows the fixing device 7 to be continuously cooled while achieving space saving and cost reduction of the image forming apparatus 100.

In still another one of the above-described illustrative embodiments, each of the circulation path 13 and the heat-receive-portion channel 22 is formed of one line, and coupling members are provided between the circulation path 13 and the heat-receive-portion channel 22. The coupling members are extensible so that the connection between the circulation path 13 and the heat-receive-portion channel 22 is maintained without being broken when the fixing device 7 is detached from the main body. Such a simple configuration allows the fixing device 7 to be continuously cooled whether the fixing device 7 is installed in or detached from the main body, while achieving space saving and cost reduction of the image forming apparatus.

Such a simple configuration can be accomplished by using as the extensible coupling members the coupling members 26 having extensibly contractible portions or the coupling members 26' having extensibly collapsible portions.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the scope of the present invention, and all such modifications are intended to be included within the scope of the present invention.

For example, elements and/or features of different illustrative embodiments may be combined with each other and/or substituted for each other within the scope of this disclosure and appended claims.

What is claimed is:

1. An image forming apparatus, comprising:

a main body;

a cooling device; and a coupling assembly, the cooling device cooling as a cooling target one of a heat generator and a neighboring portion whose temperature is raised by heat of the heat generator, the cooling device including a heat-receiving section forming a heat-receiving-section channel through which a coolant flows to absorb heat from the cooling target, a cooling section to cool the coolant, and a circulation path to circulate the coolant between the heat-receiving section and the cooling section by transporting the coolant from the heat-receiving section to the cooling section, cooling the coolant at the cooling section, and transporting the coolant back to the heat-receiving section, the cooling target detachable from the main body, the heat-receiving section detachable from the main body along with the cooling target, the cooling section provided at the main body, the coupling assembly connecting the heat-receiving-section channel and the circulation path to circulate the coolant between the heat-receiving section and the cooling section whether with the cooling target installed in or detached from the main body.

2. The image forming apparatus according to claim 1, wherein the circulation path includes a plurality of circulation lines, the heat-receiving-section channel includes a plurality of heat-receiving-section lines, and the coupling assembly includes a first coupling member to couple at least one set of a circulation line and a heat-receiving-section line out of the circulation lines and the heat-receiving-section lines with the cooling target installed in the main body and a second coupling member to couple at least one other set of a circulation line and a heat-receiving-section line out of the circulation lines and the heat-receiving-section lines with the cooling target detached from the main body, and wherein, when the cooling target is detached from the main body, the coupling of the at least one set of the circulation line and the heat-receiving-section line by the first coupling member is decoupled and the coupling of the at least one other set of the circulation line and the heat-receiving-section line by the second coupling member is formed.

3. The image forming apparatus according to claim 1, wherein the circulation path includes a plurality of circulation lines, the heat-receiving-section channel includes one heat-receiving-section line, and the coupling assembly includes a first coupling member to couple at least one circulation line of the circulation lines and the one heat-receiving-section line with the cooling target installed in the main body and a second coupling member to couple another circulation line of the circulation lines and the one heat-receiving-section line with the cooling target detached from the main body, and wherein, when the cooling target is detached from the main body, the coupling of the at least one circulation line and the one heat-receiving-section line by the first coupling member is decoupled and the coupling of the another circulation line and the one heat-receiving-section line by the second coupling member is formed.

4. The image forming apparatus according to claim 1, wherein the coupling assembly includes an extensible coupling member provided between the circulation path and the heat-receiving-section channel, the coupling member extending when the cooling target is detached from the main body to maintain connection between the heat-receiving-section channel and the circulation path.

5. The image forming apparatus according to claim 4, wherein the coupling member has an extensibly contractible portion.

6. The image forming apparatus according to claim 4, wherein the coupling member has an extensibly collapsible portion.

7. An image forming apparatus, comprising:

a main body;

a cooling device; and coupling means, the cooling device cooling as a cooling target one of a heat generator and a neighboring portion whose temperature is raised by heat of the heat generator, the cooling device including a heat-receiving section forming a heat-receiving-section channel through which a coolant flows to absorb heat from the cooling target, a cooling section to cool the coolant, and a circulation path to circulate the coolant between the heat-receiving section and the cooling section by transporting the coolant from the heat-receiving section to the cooling section, cooling the coolant at the cooling section, and transporting back the coolant to the heat-receiving section, the cooling target detachable from the main body, the heat-receiving section detachable from the main body along with the cooling target, the cooling section provided at the main body, the coupling means connecting the heat-receiving-section channel and the circulation path to circulate the coolant between the heat-receiving section and the cooling section whether with the cooling target installed in or detached from the main body.

8. The image forming apparatus according to claim 7, wherein the circulation path includes a plurality of circulation lines, the heat-receiving-section channel includes a plurality of heat-receiving-section lines, and the coupling means includes a first coupling member to couple at least one set of a circulation line and a heat-receiving-section line out of the circulation lines and the heat-receiving-section lines with the cooling target installed in the main body and a second coupling member to couple at least one other set of a circulation line and a heat-receiving-section line out of the circulation lines and the heat-receiving-section lines with the cooling target detached from the main body, and wherein, when the cooling target is detached from the main body, the coupling of the at least one set of the circulation line and the heat-receiving-section line by the first coupling member is decoupled and the coupling of the at least one other set of the circulation line and the heat-receiving-section line by the second coupling member is formed.

9. The image forming apparatus according to claim 7, wherein the circulation path includes a plurality of circulation lines, the heat-receiving-section channel includes one heat-receiving-section line, and the coupling means includes a first coupling member to couple at least one circulation line of the circulation lines and the one heat-receiving-section line with the cooling target installed in the main body and a second coupling member to couple another circulation line of the circulation lines and the one heat-receiving-section line with the cooling target detached from the main body, and wherein, when the cooling target is detached from the main body, the coupling of the at least one circulation line and the one heat-receiving-section line by the first coupling member is decoupled and the coupling of the another circulation line and the one heat-receiving-section line by the second coupling member is formed.

10. The image forming apparatus according to claim 7, wherein the coupling means includes a coupling member provided between the circulation path and the heat-receiving-section channel, the coupling member extending when the cooling target is detached from the main body to maintain connection between the heat-receiving-section channel and the circulation path.

11. The image forming apparatus according to claim 10, wherein the coupling member has an extensibly contractible portion.

12. The image forming apparatus according to claim 10, wherein the coupling member has an extensibly collapsible portion.

* * * * *